US006670923B1

(12) United States Patent
Kadambi et al.

(10) Patent No.: US 6,670,923 B1
(45) Date of Patent: Dec. 30, 2003

(54) DUAL FEEL MULTI-BAND PLANAR ANTENNA

(75) Inventors: Govind Rangaswamy Kadambi, Lincoln, NE (US); Vladimir Stoiljkovic, Aylesbury (GB); Shanmuganathan Suganthan, Watford Herts (GB)

(73) Assignee: Centurion Wireless Technologies, Inc., Lincoln, NE (US)

( * ) Notice: Subject to any disclaimer, the term of this patent is extended or adjusted under 35 U.S.C. 154(b) by 0 days.

(21) Appl. No.: 10/201,859

(22) Filed: Jul. 24, 2002

(51) Int. Cl.[7] ..... H01Q 1/38

(52) U.S. Cl. ..... 343/700 MS; 343/702; 343/847; 343/893

(58) Field of Search ..... 343/700 MS, 702, 343/846, 847, 848, 725, 729, 893, 830, 767

(56) References Cited

U.S. PATENT DOCUMENTS 6,072,434 A 6/2000 Papatheodorou ..... 343/700 MS
6,218,991 B1 4/2001 Sanad ..... 343/700 MS
6,222,496 B1 4/2001 Liu ..... 343/846
6,366,243 B1 * 4/2002 Isohatala et al. ..... 343/700 MS
6,448,932 B1 9/2002 Stoiljkovic et al. .. 343/700 MS
6,466,170 B2 * 10/2002 Zhou ..... 343/700 MS
6,476,769 B1 * 11/2002 Lehtola ..... 343/702
6,498,586 B2 * 12/2002 Pankinaho ..... 343/700 MS

* cited by examiner

*Primary Examiner*—Don Wong
*Assistant Examiner*—Shih-Chao Chen
(74) *Attorney, Agent, or Firm*—Holland & Hart LLP

(57) ABSTRACT

A three-band, two-antenna, assembly includes a planar inverted-F antenna (PIFA) having a radiating/receiving element that is spaced from and extends generally parallel to a ground plane element. The planar radiating/receiving element of an inverted-F antenna (IFA) is located in an open space that exists between the radiating/receiving element of the PIFA and the ground plane element. The radiating/receiving element of the IFA extends either perpendicular to, or parallel to, the radiating/receiving element of the PIFA. The radiating/receiving element of the PIFA includes one or more open slot configurations that operate to provide dual resonant frequencies for the IPFA (AMPS/PCS or GSM/DCS). The radiating/receiving element of the IFA operates in a non-cellular frequency band (ISM or GPS).

40 Claims, 5 Drawing Sheets

DUAL FEEL MULTI-BAND PLANAR ANTENNA

CROSS-REFERENCE TO RELATED APPLICATIONS

U.S. patent application Ser. No. 10/135,312, filed Apr. 29, 2002 by Govind R. Kadambi and Jon L. Sullivan entitled SINGLE FEED TRI BAND PIFA WITH PARASITIC ELEMENT, incorporated herein by reference

BACKGROUND OF THE INVENTION

1. Field of the Invention

This invention relates to antennas, and more specifically to antennas for use within handheld or portable wireless communication devices or handsets.

2. Description of the Related Art

State of the art cellular communication systems generally require handsets that provide both a multi-band and a multi-system capability. That is, there is a growing need for multi-purpose cellular handsets that can be utilized in cellular applications such as Advanced-Mobile-Phone-Service (AMPS), Personal-Communications-Service (PCS), Global-System-For-Mobile-Communication (GSM), Distributed-Communications-System (DCS) and Industrial Scientific Medical (ISM), and that can also be utilized in non cellular applications such as Global-Positioning-System (GPS) and Bluetooth (BT) (Bluetooth is the code name for an open specification to standardize data synchronization between disparate personal computer and handheld personal computer devices).

Current advances in cellular communication technology also provide an emphasis on providing an antenna that is internal to a cellular handset, to thereby utilize the inherent advantages that are provided by such an antenna that is buried with the wireless communication device.

The structure and arrangement that is provided by the present invention includes a planar inverted-F antenna (PIFA).

A PIFA is a compact, low profile, microstrip antenna, and it is called an inverted-F antenna because a side view of the antenna resembles the letter F facing down. U.S. Pat. Nos. 6,072,434, 6,218,991 and 6,222,496, incorporated herein by reference, are examples of PIFAs.

Multi-Band PIFAs are of interest to the mobile wireless communication industry. In a multi-band PIFA a choice between providing a single antenna feed, or providing multiple antenna feeds, tends to be dependent on system requirements. However, from the standpoint of antenna design, the choice between providing a single antenna feed or multiple antenna feeds has both merits and demerits.

In a single antenna feed, multi-band, PIFA providing a required bandwidth at multiple resonant frequencies generally leads to antenna design complexities.

On the other hand, a multi-band PIFA having multiple antenna feeds tends to diminish antenna design complexities since the design of a plurality of individual radiating/receiving elements, each having a separate feed, tends to be less difficult. However, multiple antenna feeds encounter the problem of mutual coupling between the individual radiating/receiving elements of a multi-band. PIFA. There is also a concern that a multi-band PIFA with multiple antenna feed ports may have its performance compromised due to mutual coupling and poor isolation between the PIFA's various resonant bands.

Hence, in spite of the reduced design complexities that are provided by a multi-band PIFA having multiple feeds, such a PIFA has not been a choice for practical applications, mainly due to the mutual coupling problem. In view of this, techniques that reduce the mutual coupling between the individual radiating/receiving elements of such as multi-band PIFA are important.

Past research on dual-feed, dual-band, PIFAs has emphasized optimizing the PIFA for cellular applications. However, most of the prior art dual-feed, dual-band, PIFAs exhibit an isolation of only about 15 dB.

Further improvement in the isolation that is provided by a dual-feed. dual-band, PIFA has been realized by increasing the physical separation between the antenna's multiple radiating/receiving elements. However, such an option contradicts the desirable requirement that the overall physical volume that is occupied by the PIFA be small.

Therefore, techniques which accomplish the desired objective of improved isolation without increasing the overall volume and/or linear dimensions of a multi-band PIFA are needed by the art.

The design and application of a dual-feed, dual-band, PIFA for cellular or mobile communication have been dealt with in the following publications, wherein the publications generally deal with the design of PIFA for cellular bands such as the AMPS/PCS or GSM/DCS bands.

[1] Z. D. Liu, P. S. Hall and D. Wake, "Dual-Frequency Planar Inverted-F Antenna", IEEE Trans. Antennas and Propagation Vol. AP-45, No. 10, pp. 1451–1458, October 1997.

[2] C. B. Rowelland R. D. Murch,"A Compact PIFA Suitable for Dual-frequency 900/1800—MHz Operation", IEEE Trans. Antennas and Propagation Vol. AP-46, No. 10, pp.596–598, April 1998.

[3] P. Kabacik and A. A. Kucharski,"Optimizing the radiation Pattern Of Dual Frequency Inverted F Planar antennas", JINA conference, pp.655–658, 1998.

[4] P. Song, P. S. Hall, H. Ghafouri-Shiraz and D. Wake, "Triple-Band Planar Inverted F Antenna", IEEE-APS Symposium, 1999, Orlando, pp.908–911.

Above cited reference [1] discusses an achievable isolation between the two feed ports of a GSM/DCS band PIFA. Specifically, isolation between the two ports as reported in [1] is of the order of about 15 dB. Any improvement in the isolation, while maintaining the overall volume of the PIFA, is at the expense of gain at one of the antenna ports.

To the contrary, the present invention improves the isolation (18–19 dB) between the two feed ports of two-antenna assemblies that are constructed and arranged in accordance with the present invention, without degrading the gain at the individual antenna ports. Further, the present invention does not increase the overall physical volume that is occupied by the multi-band antenna structure.

The design of a GSM/DCS/ISM Tri Band PIFA with two and three feed ports is described in above cited reference [4]. In this reference, multiple antennas are each of the PIFA type with all of the radiating elements lying on a single surface that is parallel to a ground plane. Prior art FIGS. 1–3, discussed below, show this type of arrangement.

In an embodiment of the present invention a multi-band, two-antenna assembly or module provides a combination of a PIFA and an inverted-F antenna (IFA) whose radiating elements are located in an orthogonal orientation.

An IFA is also known as a shunt-driven inverted-L antenna transmission line having an open end. That is, an IFA is a version of an inverted-L antenna having with the freedom to tap the input along the antenna's horizontal wire in order to achieve a degree of control over the antenna's input impedance.

FIG. 1 is a top view of a prior-art multi-band PIFA 10 having multiple feeds. FIG. 2 is a section view of PIFA 10 taken on line 2—2 of FIG. 1, and FIG. 3 is a section view of PIFA 10 taken on line 3—3 of FIG. 1. Multi-band PIFA 10 includes two separate feeds, one feed for each if its two frequency bands.

PIFA 10 includes radiating/receiving elements 11 and 12 that resonate at the two separate frequency-bands. Radiating/receiving elements 11 and 12 occupy a common plane, and they are positioned above and generally parallel to a ground plane element 13. An L-shaped slot 14 provides both physical and electrical separation between the two radiating/receiving elements 11 and 12.

A first hole 15 is provided in the relatively large area radiating/receiving element 11, and a conductive feed pin 16 is inserted through hole 15. Feed pin 16 is used to feed radio frequency (RF) power to radiating/receiving element 11. Feed pin 16 is electrically insulated from ground plane element 13 at the location whereat feed pin 16 passes through a hole that is provided in ground plane element 13.

A second hole 17 is provided in radiating/receiving element 11. A conductive post 18 which functions as a short circuit between radiating/receiving element 11 and ground plane element 13 is inserted through hole 17 and through a hole that is provided in ground plane element 13. Post 18 extends generally parallel to feed pin 16.

Radiating/receiving element 11, having the relatively larger dimensions of length (L1) and width (W1), resonates at the lower frequency band of multi-band PIFA 10.

Impedance matching of radiating/receiving element 11 is determined by the diameter of feed pin 16, by the diameter of shorting post 18, and by the distance that separates feed pin 16 and shorting post 18.

Radiating/receiving element 12, having the relatively smaller dimensions of length (L2) and width (W2), resonates at the higher frequency band of multi-band PIFA 10.

A first hole 19 is provided in radiating/receiving element 12. A conductive feed pin 20 is inserted through hole 19 and is used to feed RF power to radiating/receiving element 12. Feed pin 20 is electrically insulated from ground plane element 13 at the location whereat feed pin 20 passes through a hole that is provided in ground plane element 13.

A second hole 21 is provided in radiating/receiving element 12, and a conductive post 22 that passes through hole 21 provides a short circuit between radiating/receiving element 12 and ground plane element 13. Post 22 extends generally parallel to feed pin 20.

Impedance matching of radiating/receiving element 12 is determined by the diameter of feed pin 20, by the diameter of shorting post 22, and by the distance that separates feed pin 20 from shorting post 22.

Multi-band PIFA 10 illustrated in FIGS. 1–3 provides several disadvantages. For example, adequate isolation between the two frequency bands requires that a relatively large physical separation be provided between the two radiating/receiving elements 11 and 12, thus necessitating a relatively large width for L-shaped slot 14. This increased width of L-shaped slot 14 decreases the overall effective dimensions of PIFA 10, thereby reducing the bandwidth as well as the gain of PIFA 10.

In addition, any change that may be made in the frequency-separation that exists between the two resonant frequency bands of PIFA 10 involves a change in the linear dimensions L and W of the two radiating elements 11 and 12.

Z. D. Liu, P. S. Hall and D. Wake, "Dual Frequency Planar Inverted—F Antenna", IEEE Trans. Antennas and Propagation, Vol. AP-45, No. 10, pp. 1451–1548, Oct. 1997 describes a multi-band PIFA with separate feeds that is structurally configured similar to PIFA 10.

P. Kabacik and A. A. Kuchaski, "Optimizing the Radiation Pattern of Dual Frequency Inverted—F Planar Antennas", JINA Conference, pp.655–658, 1998 (hereinafter referred to as:Kabacik et al) also describes a multi band PIFA having separate feeds that is similar to PIFA 10. However in Kabacik et al, instead of providing an L-shaped slot that separates the two radiating/receiving elements, as in PIFA 10, an annular slot is proposed by Kabacik et al.

The problem of mutual coupling within a dual-feed, multi-band, PIFA is a severe constraint or drawback for the utility of such an antenna in system applications. It is possible to improve the isolation between the multiple radiating/receiving elements of a multi-band PIFA by increasing the separation distance between the radiating/receiving elements. In view of an emphasis on reducing the physical size of internal cellular antennas, this recourse of providing an increased physical separation between the radiating/receiving elements is not a practical solution.

SUMMARY OF THE INVENTION

The present invention provides a two-antenna assembly, one antenna of which is a PIFA. The second antenna of the two-assembly is contained within a physical volume that is occupied by the PIFA, such that the overall physical volume that is occupied by a two-antenna assembly in accordance with the invention is equal to the physical volume of the PIFA.

In embodiments of the invention, the second antenna's radiating/receiving element is mounted between the radiating/receiving element of the PIFA and a ground plane element, and the second antenna's radiating/receiving element extends in a plane that is perpendicular to both the plane of the radiating/receiving element of the PIFA and the plane of the ground plane element.

In other embodiments of the invention, the second antenna's radiating/receiving element is mounted between the radiating/receiving element of the PIFA and a ground plane element, and the second antenna's radiating/receiving element extends in a plane that is parallel to both the plane of the radiating/receiving element of the PIFA and the plane of the ground plane element.

The present invention provides a combined PIFA/IFA two-antenna assembly whose construction and arrangement retains the physical volume of the PIFA, and in addition minimizes the mutual coupling between the radiating/receiving elements of the two-antenna PIFA/IFA assembly.

In accordance with the invention, the PIFA portion of the two-antenna assembly is designed for dual resonance (i.e. AMPS/PCS resonance or GSM/DCS resonance) in the cellular frequency bands.

The PIFA is constructed and arranged such that the plane of the PIFA's radiating/receiving element is parallel to a flat or planar ground plane element, thereby providing a physical space between the PIFA's radiating/receiving element and its ground plane element.

In accordance with the invention, the second antenna portion (the IFA portion) of the two-antenna assembly operates in a frequency band for a non-cellular application (i.e. ISM or GPS), and the second antenna portion is constructed and arranged such that its radiating/receiving element is located in the space that exists between the radiating/receiving, element and the ground plane element of the PIFA.

In an embodiment of the invention the plane of the second antenna's radiating/receiving element extends generally parallel to the plane of the PIFA's radiating/receiving element.

In other embodiments of the invention the plane of the second antenna's radiating/receiving element extends generally perpendicular to the plane of the PIFA's radiating/receiving element.

In order to provide a Tri band two-antenna assembly within the volume that is occupied by the PIFA, in one embodiment of the invention the perpendicular-oriented radiating/receiving element of the IFA is placed (generally underneath a radiating or non-shorted edge of the PIFA's planar radiating/receiving element. This results in a orthogonal disposition of the planar radiating/receiving element of the PIFA and the planar radiating/receiving element of the IFA.

Apart from the orthogonal orientation of the two planar radiating/receiving elements, a slot contour within the radiating/receiving element of the PIFA also improves the isolation between the two feed ports that are individually provided for the PIFA and the IFA.

In other embodiments of the invention the above-described perpendicular-oriented radiating/receiving element of the IFA is placed under a non radiating or shorted edge of the PIFA's radiating/receiving element. This arrangement also results in an orthogonal disposition of the planar radiating/receiving elements of the PIFA and the IFA, this orthogonal orientation also providing isolation between the feed port of the PIFA and the feed port of the IFA.

In addition, neither of the above constructions and arrangements require that an increased physical separation be provided between the radiating/receiving elements of the PIFA.

This invention provides a dual-feed Tri-band (AMPS/PCS/ISM band or GSM/DCS/ISM band) two-antenna assembly having good gain, having a reasonable bandwidth and having improved isolation, such as −18 dB, between the multiple feed ports of the two-antenna assembly.

This invention provides a dual-feed Tri-band (AMPS/PCS/GPS bands) two-antenna assembly having good gain, having a reasonable bandwidth and having improved isolation better than −18 dB between the multiple feed ports of the two-antenna assembly.

In accordance with the invention the physical volume that is required by the IFA is physically placed within the volume that is required by the PIFA. In such an arrangement, the radiating/receiving element of the IFA is located under the radiating/receiving element of the PIFA, and the radiating/receiving element of the IFA may be either parallel-to or perpendicular-to the radiating/receiving element of the PIFA.

Although the advantage of improved isolation is reduced when the radiating/receiving element of the IFA is under and parallel-to the radiating/receiving element of the PIFA, this construction and arrangement in accordance with the invention improves the gain within the ISM band of the IFA, and in addition the bandwidth of both the PIFA and the IFA is improved.

This invention provides a bandwidth characteristic and an isolation characteristic for several planar, compact, dual-feed, Tri band/Quad band. two-antenna assemblies having utility in both cellular and non-cellular applications.

Within the spirit and scope of this invention, the invention can also be utilized to improve the isolation performance of a dual-feed, dual-band, PIFA two-antenna assembly wherein the PIFA provides for either AMPS or GSM operation, and wherein the IFA provides for PCS or DCS or ISM or GPS operation.

An important feature of the invention is minimizing the coupling between the two-antenna assembly's multiple radiating/receiving elements, which in turn improves the isolation between the individual feed ports that are provided for each of the radiating/receiving elements.

The present invention provides a two-antenna assembly that is formed by a new and an unusual combination of a PIFA and an IFA. The construction and arrangement of the two-antenna assembly results in minimizing the mutual coupling between the two antenna feed ports, without increase in the physical volume that is required by the PIFA itself. The present invention's technique for improving the isolation between the two antenna feed ports also retains the desirable physical compactness requirement of a multi-band two-antenna assembly.

The present invention's improvement in isolation between the two antenna feed ports that individually support the cellular band and the noncellular band does not result in a deterioration of the radiation/polarization characteristics of the radiating/receiving elements.

DESCRIPTION OF THE INVENTION

Figure 1:
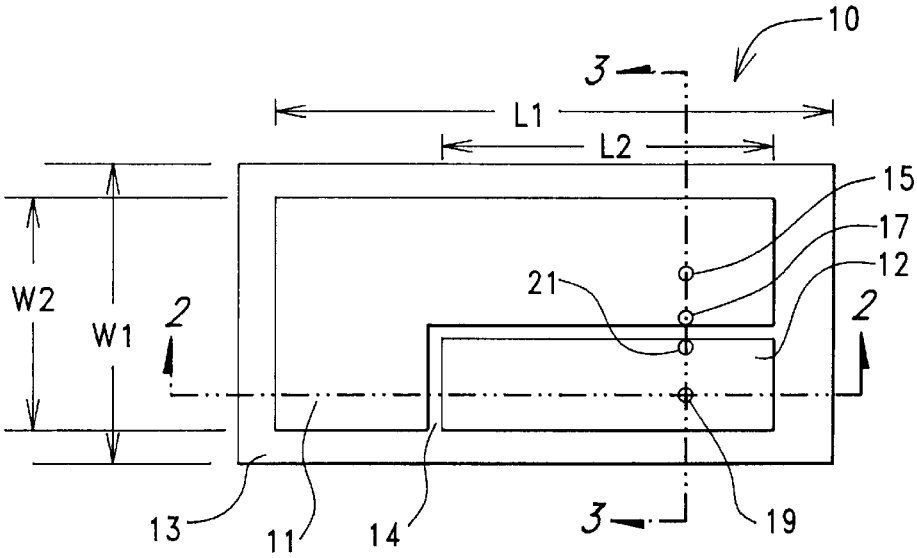
FIG. 1 PRIOR ART
FIG. 1 is a top view of a prior art multi-band PIFA having multiple feeds.
Figure 3:
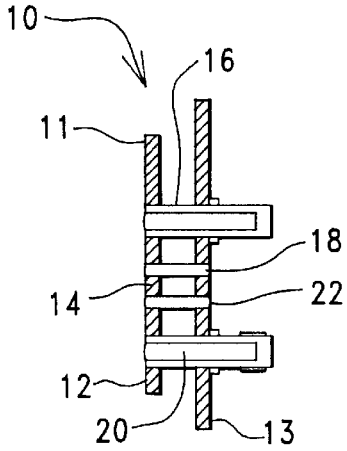
FIG. 3 PRIOR ART
FIG. 3 is a section view of the PIFA of FIG. 1 taken on line 3—3 of FIG. 1.
Figure 2:
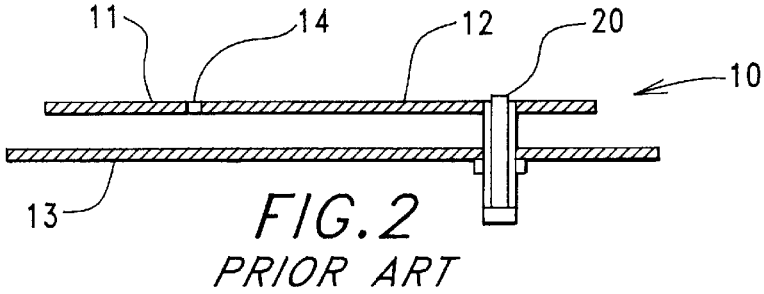
FIG. 2 PRIOR ART
FIG. 2 is a section view of the PIFA of FIG. 1 taken on line 2—2 of FIG. 1.
Figure 4:
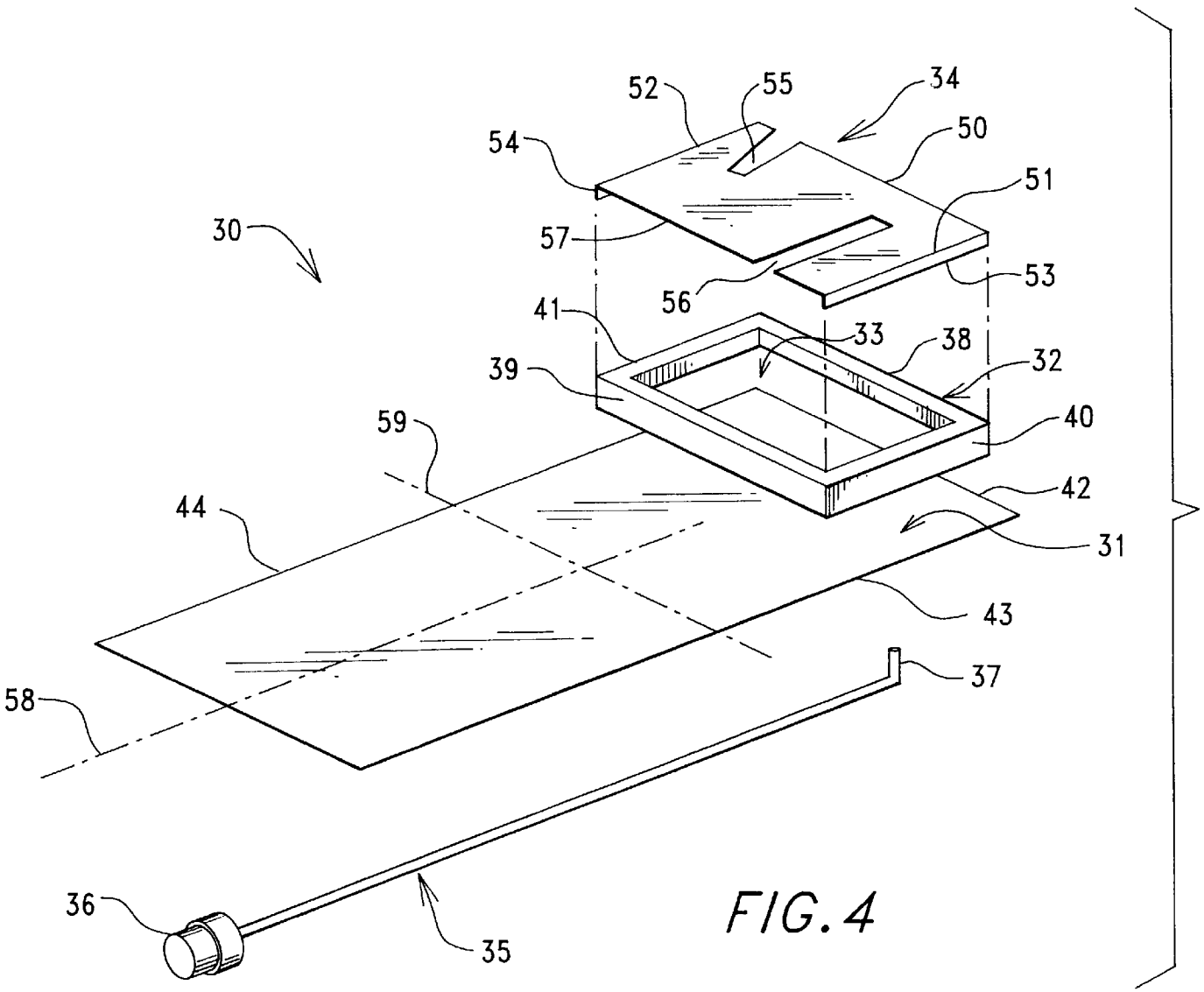
FIG. 4 is an exploded top view that shows only the PIFA portion of a two-antenna assembly in accordance with the present invention.

FIG. 4 is an exploded top and side view that shows only the PIFA portion 30 of a two-antenna assembly that is constructed and arranged in accordance with the present invention.

PIFA 30 includes four basic structural elements, i.e. (1) a rectangular, flat and metallic ground plane element 31, (2) a four-wall, box-shaped and relatively rigid dielectric carriage 32 whose four walls 38–41 define a box-shaped open cavity 33, (3) a generally flat and metallic radiating/receiving element 34, and (4) a coaxial feed cable 35 having an RF connector 36 at one end and an exposed and upward-extending centrally located metal conductor 37 at the other end.

The four side edges of radiating/receiving element 34 rest on and are physically supported by the top surface of the four walls 38–41 of dielectric carriage 32, such that a plane that is occupied by radiating/receiving element 34 is generally parallel to a plane that is occupied by ground plane element 31.

Ground plane element 31 is in the form of a rectangle having a major axis 58 and a minor axis 59.

Dielectric carriage 32 is in the form of a rectangle having two parallel and relatively long walls 38 and 39 that extend generally parallel to the minor axis 59 of ground plane element 31, and having two parallel and relatively short walls 40 and 41 that extend generally parallel to the major axis 58 of ground plane element 31.

Each of the four walls 38–41 of dielectric carriage 32 include an outer surface and inner surface that faces open cavity 33.

The bottom surface of the four walls 38–41 that form dielectric carriage 32 provide a planar and box-shaped surface on which metallic ground plane element 31 is mounted such that the long wall 38 of dielectric carriage 32 is located closely adjacent to the short edge 42 of ground plane element 31, and such that the two short walls 40 and 41 of dielectric carriage are respectively located closely adjacent to the two long edges 43 and 44 of ground plane element 31.

As stated above, the top surface of the four walls 38–41 that form dielectric carriage 32 provide a planar box-shaped surface on which metallic radiating/receiving element 34 is mounted.

Radiating/receiving element 34 is of generally the same box-shape as dielectric carriage 32, and a conductive metal strip (not shown) is provided to short the edge 50 of radiating/receiving element 34 to ground plane element 31 at or adjacent to its edge 42.

The two opposite edges 51 and 52 of radiating/receiving element 34 are bent about 90-degrees downward in order to form two metallic capacitive loading plates 53 and 54 for radiating/receiving element 34, one loading plate 54 for tuning a lower resonant frequency of radiating/receiving element 34, and the other loading plate 53 for tuning an upper resonant frequency of radiating/receiving element 34.

Radiating/receiving element 34 also includes a first inclined slot 55 that provides a reactive loading that operates to lower the resonant frequency of the lower frequency band, and a second slot 56 that provides a reactive loading that operates to lower the resonant frequency of the upper frequency band.

Coaxial feed cable 35 and its RF connector 36 provide an electrical connection to radiating/receiving element 34. That is, the exposed center metal conductor 37 of feed cable 35 extends generally 90-degrees upward and passes through ground plane element 31 in such a manner that conductor 37 is insulated from ground plane element 31. Conductor 37 then passes adjacent to the outer surface of the long wall 38 of dielectric carriage 32, whereupon conductor 37 electrically connects to a metal tab (not shown) that extends generally 90-degees downward from the edge 50 of radiating/receiving element 34

In FIG. 4, the edge 50 of radiating/receiving element 34 that is shorted to ground plane element 31 can be called a non-radiating edge. whereas the opposite edge 57 of radiating/receiving element 34 can be called a radiating edge.

Figure 5:
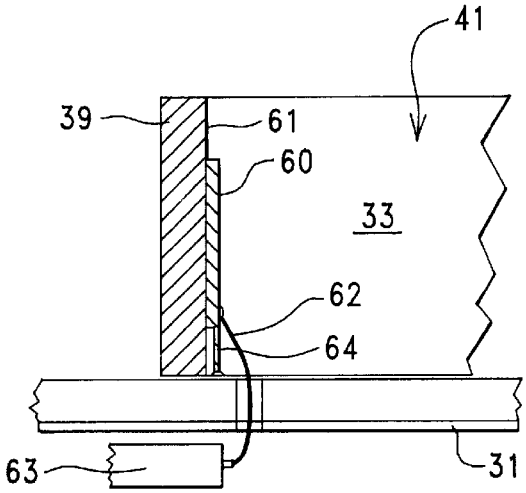
FIG. 5 is an enlarged side section view that shows the planar radiating/receiving element of a second antenna mounted on an outer surface of one of the long-walls of the PIFA's box-shaped dielectric carriage shown in FIG. 4, such that this second radiating/receiving element is located generally under the radiating edge of the PIFA's radiating/receiving element, and such that the plane of this second radiating/receiving element extends generally perpendicular to the plane of the PIFA's radiating/receiving element and to the plane of the ground plane element.

FIG. 5 is an enlarged side section view that shows the planar radiating/receiving element 60 of a second antenna that generally occupies the cavity or space 33 that is shown in FIG. 4 between the radiating/receiving element 34 of PIFA 30 and ground plane element 31.

In this embodiment of the invention the radiating/receiving element 60 of the second antenna is mounted on the inner surface 61 of the long-wall 39 of the box-shaped dielectric carriage 32 that is shown in FIG. 4. In this embodiment of the invention the second radiating/receiving element 60 is located generally under the radiating edge 57 of the PIFA's radiating/receiving element 34, such that the plane of this second radiating/receiving element 60 extends generally perpendicular to the plane of radiating/receiving element 34 and the plane of ground plane element 31.

Figure 6:
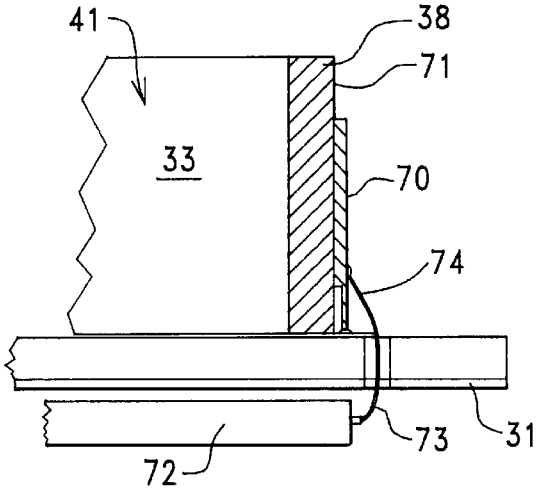
FIG. 6 is an enlarged side section view that shows the planar radiating/receiving element of a second antenna mounted on an outer surface of one of the long-walls of the PIFA's box-shaped dielectric carriage shown in FIG. 4, such that this second radiating receiving element is located generally under the non-radiating edge of the PIFA's radiating/receiving element, and such that the plane of this second radiating/receiving element extends generally perpendicular to the plane of the PIFA's radiating/receiving element and to the plane of the ground plane element.
Figure 7:
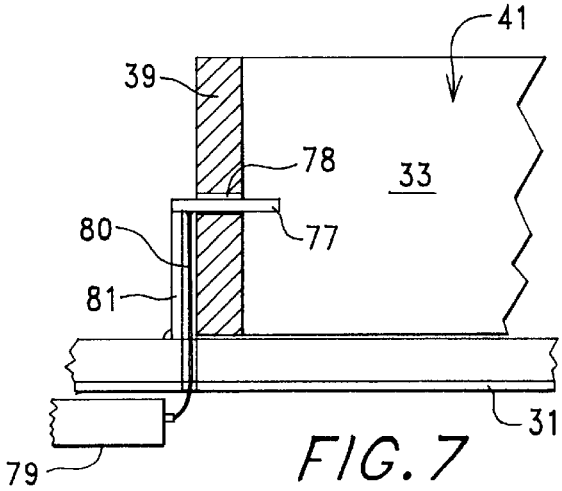
FIG. 7 is an enlarged side section view that shows the planar radiating/receiving element of a second antenna mounted on one of the long-walls of the PIFA's box-shaped dielectric carriage shown in FIG. 4, such that this second radiating/receiving element is located under and extends generally parallel to the PIFA's radiating/receiving element, and such that the plane of this second radiating/receiving element extends generally parallel to the plane of the ground plane element.

In FIGS. 5–7 the structural member that includes ground plane element 31 may be in the form of a printed circuit board (PCB) having a metal sheet that is located either on the top of or on the bottom of the PCB.

Feed to the second antenna that is formed by radiating/receiving element 60 and ground plane element 31 (an IFA) is provided by a coaxial cable 63 whose center metal conductor 62 is insulated from ground plane element 31, is electrically connected to radiating/receiving element 60, and extends into cavity 33.

A relatively narrow metal strip 64 electrically connects a point on radiating/receiving elements 60 to ground plane element 31.

FIG. 6 is an enlarged side section view of another embodiment of the invention wherein the planar radiating/receiving element 70 of a second antenna (an IFA) is mounted on the outer surface 71 of the long-wall 38 of the box-shaped dielectric carriage 32 that is shown in FIG. 4.

In this embodiment of the invention the second radiating/receiving element 70 is located generally under the non-radiating edge 50 of the PIFA's radiating/receiving element 34, such that the plane of this second radiating/receiving element 70 extends generally perpendicular to the plane of the PIFA's radiating/receiving element 34 and to the plane of ground plane element 31.

Again, the second radiating/receiving element 60 of the second antenna generally occupies the cavity or space 33 that is shown in FIG. 4 between the radiating/receiving element 34 of PIFA 30 and ground plane element 31.

Feed to the second antenna that is formed by radiating,/receiving element 70 and ground plane element 31 is provided by a coaxial cable 72 whose center metal conductor 73 is insulated from ground plane element 31 as it passes through around plane element 3 1, is electrically connected to radiating,/receiving element 70, and extend external to cavity 33. A relatively narrow metal strip 74 electrically connects a point on radiating/receiving elements 70 to ground plane element 31.

FIG. 7 shows an embodiment of the invention wherein the planar radiating/receiving element 77 of a second antenna is again mounted between the PIFA's radiating/receiving element 34 and ground plane element 31. However in this embodiment of the invention the plane of radiating/receiving element 77 extends generally parallel to the plane of radiating/receiving element 34 and to the plane of ground plane element 31.

More specifically, FIG. 7 is an enlarged side section view that shows the planar radiating/receiving element 77 of a second antenna penetrating a slot 78 that is provided in the long wall 39 of the PIFA's box-shaped dielectric carriage 32, generally midway between the PIFA's radiating/receiving element 34 and ground plane element 31. As such, this second radiating/receiving element 77 is located under and extends generally parallel to the PIFA's radiating/receiving element 34, and such that the plane of the second radiating/receiving element 77 extends generally parallel to the plane of ground plane element 31.

As discussed above relative to FIGS. 5 and 6, the second radiating/receiving element 77 of the second antenna generally occupies the cavity or space 33 that is shown in FIG. 4 between the radiating/receiving element 34 of PIFA 30 and ground plane element 31.

Feed to the second antenna that is formed by radiating/receiving element 77 and ground plane element 31 is provided by a coaxial cable 79 whose center metal conductor 80 is insulated from ground plane element 13, is electrically connected to radiating/receiving element 77, and is located external of cavity 33. A relatively narrow metal strip 81 electrically connects a point on radiating/receiving elements 77 to ground plane element 31.

While the FIG. 7 second antenna that is made up of radiating/receiving element 77 and ground plane element 31 may be called a PIFA, because the dimension of radiating/receiving element 77 as measured along the major axis 58 of ground plane element 31 is small compared to its dimension along the minor axis 59 of ground plane element 31, this second antenna can be called an IPA.

In summary, the present invention provides a two-antenna assembly that is formed by the new and unusual structural combination of a first antenna (see PIFA 30 of FIG. 4) and a second antenna (see FIGS. 5, 6 and 7).

The construction and arrangement of this two-antenna assembly results in minimizing the mutual coupling between the two antenna feed ports (see the first feed port 35 of FIG. 4, and the second feed port 63 of FIG. 5, or 72 of FIG. 6, or 79 of FIG. 7), without increase in the overall physical volume that is required by the construction and arrangement of the first antenna itself.

The present invention's technique for improving the isolation between the two antenna feed ports that are provided for the two-antenna assembly also retains a desirable physical compactness requirement of a multi-band two-antenna assembly.

The present invention's improvement in the isolation that is provided between the two antenna feed ports that individually support the cellular band (see PIFA 34) and the non-cellular band (see the second antenna of FIG. 5, FIG. 6 or FIG. 7) does not result in the deterioration of the radiation/polarization characteristics of the two radiating/receiving elements (see 34 of FIG. 4, and 60 of FIG. 5, or 70 of FIG. 6, or 77 of FIG. 7).

Figure 8:
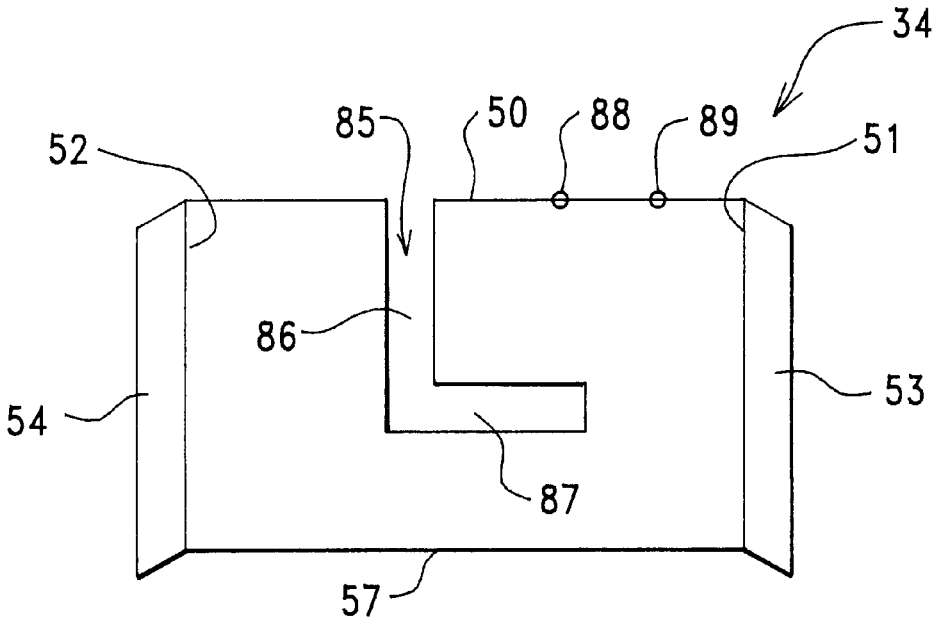
FIG. 8 shows an embodiment of the invention wherein the radiating/receiving element of FIG. 4's PIFA includes only a single L-shaped slot, the position and the dimensions of this single slot operating to control the resonance characteristics of the PIFA's lower frequency band and upper frequency band.

FIG. 8 shows an embodiment of the invention wherein the radiating/receiving element 34 of FIG. 4's PIFA includes a single L-shaped slot 85, the position and the dimensions of this single L-shaped slot 85 operating to control the resonance characteristics of the PIFA's lower frequency band and upper frequency band.

For example, a two-antenna assembly having the FIG. 8 PIFA radiating/receiving element 34 provides an AMPS/PCS/GPS, dual-feed, two-antenna assembly that includes a PIFA and an IFA.

In FIG. 8, instead of providing FIG. 4's slot 55 that is inclined to the major axis 58 of ground plane element 31 and FIG. 4's slot 56 that extends generally parallel to major axis 58, the PIFA radiating/receiving element 34 of FIG. 8 provides an L-shaped slot 85 whose first portion 86 extends generally parallel to major axis 58 and whose second portion 87 extends generally perpendicular to major axis 58.

The open edge of L-shaped slot 85 (i.e. the open end of first slot portion 86) lies on the non-radiating edge 50 of radiating/receiving element 34, this open edge of L-shaped slot 85 lies to the left of the point 88 whereat radiating/receiving element 34 is connected to ground plane element 31, and this open edge of L-shaped slot 85 lies to the left of the point 89 whereat the PIFA's feed conductor 37 of FIG. 4 is connected to radiating/receiving element 34.

The FIG. 8 embodiment of the invention eliminates slot 56 of FIG. 4 whose open edge lies on the radiating edge 57 of the FIG. 4 radiating/receiving element 34. When the radiating/receiving element 34 of the above-mentioned second antenna or IFA is placed under the radiating edge 57 of the PIFA's radiating/receiving element 34, as shown in FIGS. 5 and 7, slot 56 of FIG. 4 has an influence on the isolation that exists between the PIFA and the IFA. In FIG. 8, the absence of FIG. 4's slot 56 having an open slot-edge located on the radiating edge 57 of radiating/receiving element 34 improves the isolation between the PIFA and the IFA.

The use of the single L-shaped slot 85 shown in FIG. 8 provides an additional feature in that the position of L-shaped slot 85 influences the dual-polarization properties of the PIFA, thus providing that the radiation patterns of the PIFA's upper and lower frequency bands are oppositely polarized.

Figure 9:
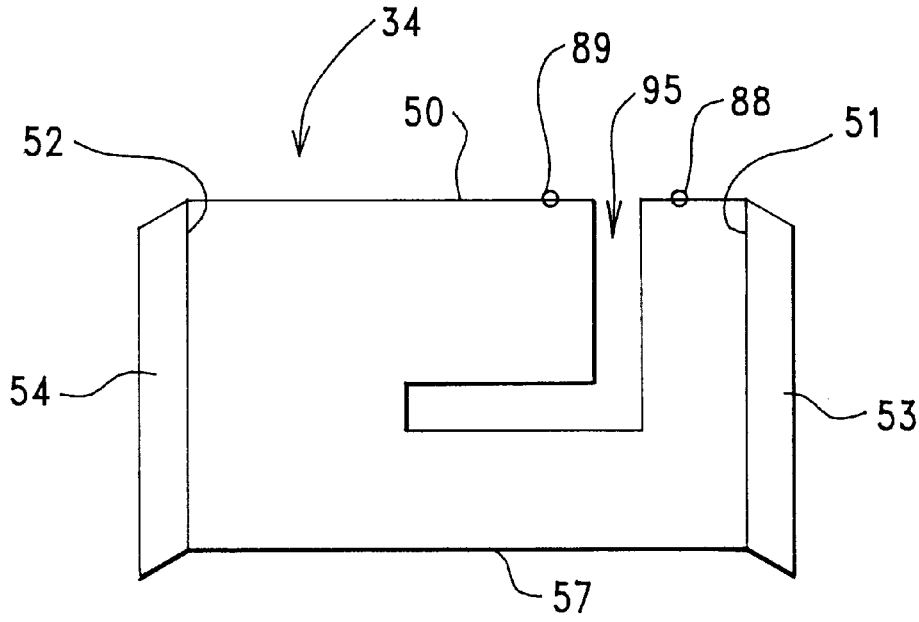
FIG. 9 shows another embodiment of the invention wherein the radiating/receiving element of FIG. 4's PIFA includes only a single L-shaped slot, the position and the dimensions of this single slot operating to control the resonance characteristics of the PIFA's lower frequency band and upper frequency band.

FIG. 9 shows another embodiment of the invention wherein the radiating/receiving element 34 of FIG. 4's PIFA includes a single L-shaped slot 95, the position and the dimensions of this single slot 95 operating to control the resonance characteristics of the PIFA's lower frequency band and upper frequency band.

That is, L-shaped slot 95 shown in FIG. 9 replaces the inclined slot 55 and the slot 56 of FIG. 4. As was true in FIG. 8, L-shaped slot 95 controls the resonant characteristics of the PIFA in both the lower and upper frequency bands.

A difference between the embodiment of FIG. 9 and the embodiment of FIG. 8 is that the open end of FIG. 9's L-shaped slot 95 (i.e. the open end of slot 95 that is located on the non-radiating edge 50 of radiating/receiving element 34) lies to the left of the point 88 whereat radiating/receiving element 34 is connected to ground plane element 31 (as in FIG. 8), but in FIG. 9 this open end of L-shaped slot 95 lies to the right of the point 89 whereat the PIFA's feed conductor 37 of FIG. 4 is connected to FIG. 9's radiating/receiving element 34.

In FIG. 9 the elimination of FIG. 4's 56having an open edge located on the radiating edge 57 of radiating/receiving element 34 improves the isolation between the PIFA and the IFA of the two-antenna assembly, particularly when the radiating/receiving element of the IFA is placed under the radiating edge of the PIFA's radiating/receiving element as shown in FIGS. 5 and 7.

However, the slot configuration of FIG. 9 does not provide the above-described dual polarization-feature, which implies that the radiation patterns of the lower and upper frequency bands have the same polarization when the slot configuration of FIG. 9 is used.

Figure 10:
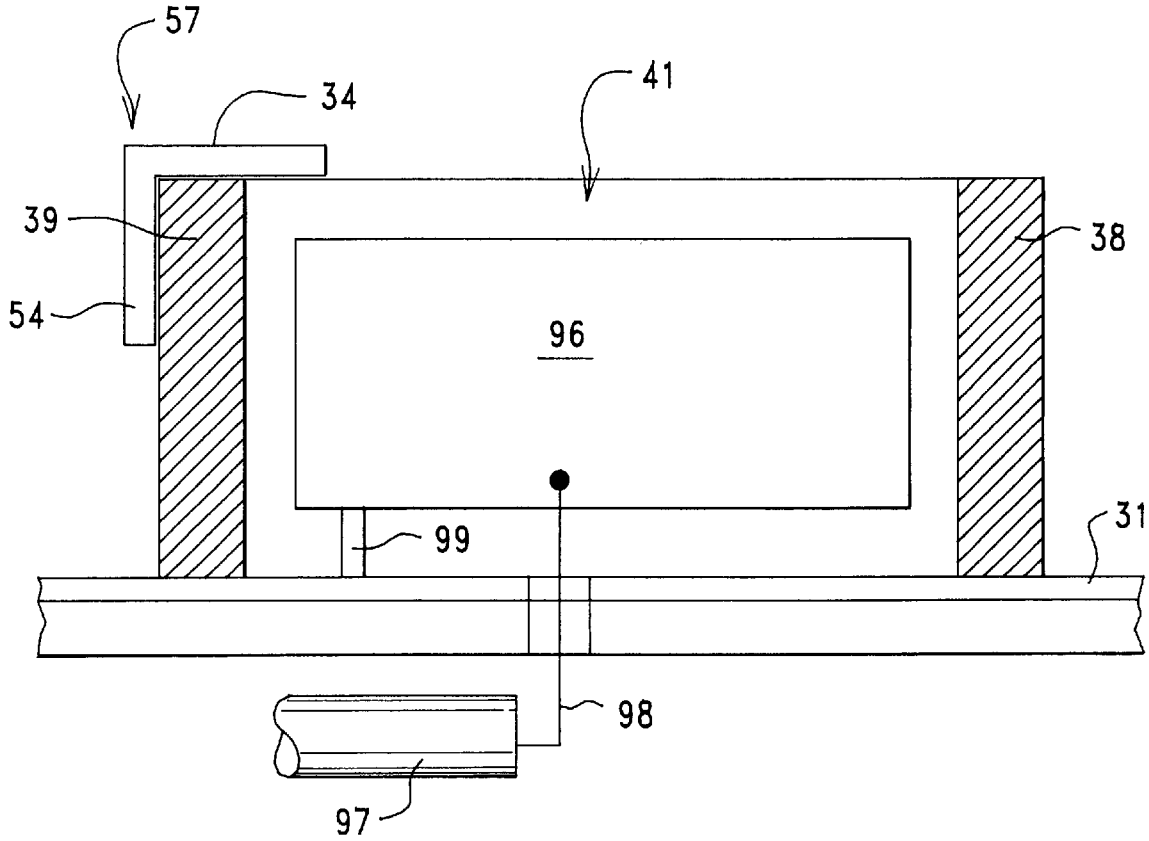
FIG. 10 shows two other embodiments of the invention wherein the IFA's radiating/receiving element is selectively located on the inside surface, or on the outside surface, of a selected one of the two walls of the FIG. 4 dielectric carriage that extend generally parallel to the major axis of the ground plane element, and wherein the capacitive loading plate that is shown located on this selected wall in FIG. 4 has been moved to the wall of the dielectric carriage that underlies the radiation edge of the PIFA's radiating/receiving element and that extends generally perpendicular to the major axis of the ground plane element.

FIG. 10 shows two other embodiments of the invention wherein the IFA's radiating/receiving element 96 is selectively located on the inside surface, or on the outside surface, of a selected one of the two walls 40 or 41 of the FIG. 4 dielectric carriage 32 that extend generally parallel to the major axis 59 of ground plane element 31, and wherein the capacitive loading plate 53 or 54 that is shown located on this selected one of the two walls 40 and 41 wall in FIG. 4 has been moved to the wall 39 of the dielectric carriage that underlies the radiation edge 57 of the PIFA's radiating/receiving element 34 and extends generally perpendicular to the major axis 58 of ground plane element 31.

That is, FIG. 10 shows embodiments of the invention wherein the IFA's radiating/receiving element 96 is located on the inside surface (or the outside surface) of the wall 41 of dielectric carriage 32, radiating/receiving element 96 being connected to ground plane element 31 by way of a metal tab 99, and radiating/receiving element 96 being connected to the center conductor 98 of a feed cable 97.

A similar embodiment of the invention provides that the IFA's radiating/receiving element 96 is located on the inside surface (or the outside surface) of the opposite wall 40 of dielectric carriage 32, and is connected to ground plane element and a feed cable as shown in FIG. 10.

In the FIG. 10 embodiment of the invention, the one of the two capacitive loading plates 53 or 54 of FIG. 4 that is eliminated, as above-described, can optionally be moved to the radiating edge 57 of the PIFA's radiating/receiving element 34, as is shown in FIG. 10.

While the invention has been particularly shown and described with reference to a preferred embodiment thereof, it will be understood by those skilled in the art that various other changes in the form and details may be made without departing from the spirit and scope of the invention.

What is claimed is:

1. A method of making a unitary assembly that contains two antennas, comprising the steps of:

providing a planar inverted-F antenna having a radiating/receiving element that is spaced from and extends generally parallel to a planar ground plane element;

providing an inverted-F antenna having a planar radiating/receiving element; and locating said radiating/receiving element of said inverted-F antenna in a space that exists between said radiating/receiving element of said planar inverted-F antenna and said planar ground plane element.

2. The method of claim 1 wherein said radiating/receiving element of said inverted-F antenna extends generally perpendicular to said ground plane element and said radiating/receiving element of said planar inverted-F antenna.

3. The method of claim 1 wherein said radiating/receiving element of said inverted-F antenna extends generally parallel to said ground plane element and said radiating/receiving element of said planar inverted-F antenna.

4. A method of making a unitary two-antenna assembly that is responsive to three frequency bands, comprising the steps of:

providing a planar inverted-F antenna having a generally planar radiating/receiving element that is spaced from and extends generally parallel to a generally planar ground plane element;

configuring said radiating/receiving element of said planar inverted-F antenna to be responsive to a first and a second frequency band;

providing an inverted-F antenna having a planar radiating/receiving element;

configuring said radiating/receiving element of said inverted-F antenna to be responsive to a third frequency band; and locating said radiating/receiving element of said inverted-F antenna in said space between said radiating/receiving element of said planar inverted-F antenna and said ground plane element.

5. The method of claim 4 wherein said radiating/receiving element of said inverted-F antenna extends generally perpendicular to said ground plane element and to said radiating/receiving element of said planar inverted-F antenna.

6. The method of claim 4 wherein said radiating/receiving element of said inverted-F antenna extends generally parallel to said ground plane element and to said radiating/receiving element of said planar inverted-F antenna.

7. The method of claim 4 wherein said radiating/receiving element of said planar inverted-F antenna includes a plurality of spaced-apart slots that operate to provide said response to said first and said second frequency band.

8. The method of claim 7 wherein said radiating/receiving element of said inverted-F antenna extends generally perpendicular to said ground plane element and to said radiating/receiving element of said planar inverted-F antenna.

9. The method of claim 4 wherein said radiating/receiving element of said inverted-F antenna extends generally parallel to said ground plane element and to said radiating/receiving element of said planar inverted-F antenna.

10. The method of claim 4 wherein said first and second frequency bands include AMPS/PCS and GSM/DCS frequency bands, and wherein said third frequency band is a non-cellular frequency band.

11. The method of claim 10 wherein said radiating/receiving element of said inverted-F antenna extends generally perpendicular to said ground plane element and to said radiating/receiving element of said planar inverted-F antenna.

12. The method of claim 10 wherein said radiating/receiving element of said inverted-F antenna extends generally parallel to said ground plane element and to said radiating/receiving element of said planar inverted-F antenna.

13. A unitary two-antenna assembly, comprising:

a generally planar metal ground plane element;

a first generally planar metal radiating/receiving element;

a dielectric member supporting said first radiating/receiving element generally parallel to said ground plane element in a manner to provide an open space between said ground plane element and said first radiating/receiving element;

a first antenna feed conductor connected to said first radiating/receiving element;

said ground plane element, said first radiating/receiving element, and said first antenna feed conductor forming a first antenna;

a second generally planar metal radiating/receiving element associated with said dielectric member in a manner to be located generally within said open space; and a second antenna feed conductor connected to said second radiating/receiving element;

said ground plane element, said second radiating/receiving element, and said second antenna feed conductor forming a second antenna.

14. The unitary two-antenna assembly of claim 13 wherein said second radiating/receiving element extends generally parallel to said ground plane element and said first radiating/receiving element.

15. The unitary two-antenna assembly of claim 13 wherein said second radiating/receiving element extends generally perpendicular to said ground plane element and said first radiating/receiving element.

16. The unitary two-antenna assembly of claim 13 wherein said first radiating/receiving element includes a radiating edge and a non-radiating edge, and including:

first conductor means electrically connecting a first point on said non-radiating edge to said ground plane element; and second conductor means electrically connecting said first feed conductor to a second point on said non-radiating edge that is spaced from said first point on said non-radiating edge.

17. The unitary two-antenna assembly of claim 16 including:

an open-slot configuration formed in said first radiating/receiving element causing, said first radiating/receiving element to be responsive to a first and a second frequency band.

18. The unitary two-antenna assembly of claim 17 wherein said open-slot configuration includes a generally L-shaped slot having an open-end that resides on said non-radiating edge at a location that is to one side of both said first and second point on said non-radiating edge.

19. The unitary two-antenna assembly of claim 18 wherein said second radiating/receiving element extends generally parallel to said ground plane element and said first radiating/receiving element.

20. The unitary two-antenna assembly of claim 18 wherein said second radiating/receiving element extends generally perpendicular to said ground plane element and said first radiating/receiving element.

21. The unitary two-antenna assembly of claim 17 wherein said open-slot configuration includes a generally L-shaped slot having an open-end that resides on said non-radiating edge at a location that is between said first and second point on said non-radiating edge.

22. The unitary two-antenna assembly of claim 21 wherein said second radiating/receiving element extends generally parallel to said ground plane element and said first radiating/receiving element.

23. The unitary two-antenna assembly of claim 21 wherein said second radiating/receiving element extends generally perpendicular to said ground plane element and said first radiating/receiving element.

24. The unitary two-antenna assembly of claim 16 including:

an open-slot configuration formed in said first radiating/receiving element causing said first radiating/receiving element to be responsive to a first and a second frequency band, and wherein said second radiating/receiving element is configured to be responsive to a third frequency band.

25. The unitary two-antenna assembly of claim 24 wherein said first and second frequency bands are selected from the group AMPS. PCS, GSM and DCS, and wherein said third frequency band is a non-cellular frequency band.

26. The unitary two-antenna assembly of claim 25 wherein said second radiating/receiving element extends generally parallel to said ground plane element and said first radiating/receiving element.

27. The unitary two-antenna assembly of claim 25 wherein said second radiating/receiving element extends generally perpendicular to said ground plane element and said first radiating/receiving element.

28. The unitary two-antenna assembly of claim 16 including:

third conductor means connecting a point on said second radiating/receiving element to said ground plane element.

29. The unitary two-antenna assembly of claim 28 including:

an open-slot configuration formed in said first radiating/receiving element causing said first radiating/receiving element to be responsive to a first and a second frequency band.

30. The two-antenna assembly of claim 29 wherein said second radiating/receiving element is configured to be responsive to a third frequency band.

31. The unitary two-antenna assembly of claim 30 wherein said second radiating/receiving element extends generally parallel to said ground plane element and said first radiating/receiving element.

32. The unitary two-antenna assembly of claim 30 wherein said second radiating/receiving element extends generally perpendicular to said ground plane element and said first radiating/receiving element.

33. A unitary two-antenna assembly, comprising:

a ground plane element;

a first radiating/receiving element;

dielectric means supporting said first radiating/receiving element relative to said ground plane element in a manner to provide an open space between said ground plane element and said first radiating/receiving element;

first feed means connected to said first radiating/receiving element;

first conductor means connecting a point on said first radiating/receiving element to said ground plane element;

said ground plane element, said first radiating/receiving element, said first feed means, and said first conductor means forming a planar inverted-F antenna;

a second radiating/receiving element supported by said dielectric means generally within said open space;

second feed means connected to said second radiating/receiving element; and second conductor means connecting a point on said second radiating/receiving element to said ground plane element;

said ground plane element, said second radiating/receiving element, said second feed means, and said second conductor means forming an inverted-F antenna.

34. The unitary two-antenna assembly of claim 33 wherein said first radiating/receiving element includes a radiating edge and a non-radiating edge, wherein said first feed means connects to a first point on said non-radiating edge, and wherein said first conductor means connects to a second point on said non-radiating edge.

35. The unitary two-antenna assembly of claim 34 including:

at least one open-slot configuration formed in said first radiating/receiving element causing said first radiating/receiving element to be responsive to a first and a second frequency band, and wherein said second radiating/receiving element is responsive to a third frequency band.

36. The unitary two-antenna assembly of claim 35 wherein said at least one open-slot configuration includes a generally L-shaped slot having an open-end that resides on said non-radiating edge at a location that is to one side of both said first and second point on said non-radiating edge.

37. The unitary two-antenna assembly of claim 35 wherein said at least one open-slot configuration includes a generally L-shaped slot having an open-end that resides on said non-radiating edge at a location that is between said first and second point on said non-radiating edge.

38. The unitary two-antenna assembly of claim 35 wherein said first and second frequency bands are selected from the group AMPS, PCS, GSM and DCS, and wherein said third frequency band is a non-cellular frequency band.

39. The unitary two-antenna assembly of claim 35 wherein said second radiating/receiving element extends generally parallel to said ground plane element and said first radiating/receiving element.

40. The unitary two-antenna assembly of claim 35 wherein said second radiating/receiving element extends generally perpendicular to said ground plane element and said first radiating/receiving element.

* * * * *